US008896640B2

(12) United States Patent
Zheng et al.

(10) Patent No.: US 8,896,640 B2
(45) Date of Patent: Nov. 25, 2014

(54) DISLPLAY PANEL, FLAT-PANEL DISPLAY DEVICE AND DRIVING METHOD THEREOF

(75) Inventors: Hua Zheng, Guandong (CN); Cheng-hung Chen, Guandong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 208 days.

(21) Appl. No.: 13/578,622

(22) PCT Filed: Jun. 13, 2012

(86) PCT No.: PCT/CN2012/076820

§ 371 (c)(1), (2), (4) Date: Aug. 11, 2012

(87) PCT Pub. No.: WO2013/181860

PCT Pub. Date: Dec. 12, 2013

(65) Prior Publication Data

US 2013/0321478 A1 Dec. 5, 2013

(30) Foreign Application Priority Data

Jun. 5, 2012 (CN) ..... 2012 1 0183311

(51) Int. Cl.
*G09G 5/10* (2006.01)

(52) U.S. Cl.
CPC ..... *G09G 5/10* (2013.01)
USPC ..... 345/690

(58) Field of Classification Search
CPC combination set(s) only.
See application file for complete search history.

(56) References Cited

U.S. PATENT DOCUMENTS 8,154,538 B2 * 4/2012 Ryu ..... 345/204
8,390,456 B2 * 3/2013 Puleston et al. ..... 340/572.1
8,390,604 B2 * 3/2013 Ryu ..... 345/204

* cited by examiner

*Primary Examiner* — Van Chow
(74) *Attorney, Agent, or Firm* — Andrew C. Cheng

(57) ABSTRACT

The display panel includes data driven chip and at least two scanning driven chips. The second scanning signal input terminal of each of the scanning driven chip is connected to a first scanning signal output terminal of the data driven chip by corresponding transmission circuits. At least one transmission circuit includes a serially connected resistor so that sum of impedance of the transmission circuits are equal, or the difference of the impedance of the transmission circuit is less than a predetermined value. In addition, a flat-panel display device with uniform brightness and a driving method thereof are also provided.

14 Claims, 4 Drawing Sheets

DISLPLAY PANEL, FLAT-PANEL DISPLAY DEVICE AND DRIVING METHOD THEREOF

BACKGROUND OF THE INVENTION

1. Field of the Invention

The present invention relates to flat displays, more particularly to display panels, flat-panel display devices, and the driving method thereof.

2. Discussion of the Related Art

Demand for thinner, lighter, power-saving flat-panel display devices with enhanced visional effect has increased nowadays. The parameters relative to performance of the display devices includes contrast, brightness, viewing angel, response time, and so on. Among the above factors, brightness, winch is determined by the backlight source and the layout of driven chips, is the most important one.

Referring to FIGS. 1 and 2, the flat-panel display device includes a display panel 11, a printed circuit board 12, a source driven IC 13, a first gate driven IC 14 and a second gate driven IC 15. The printed circuit board 12 and the electrically connected source driven IC 13 are arranged in a lateral area vertical to data lines (not shown) of the display panel 11. The first gate driven IC 14 and the second gate driven IC 15 are arranged in a lateral area vertical to gate lines (not shown) of the display panel 11. With respect to the distance to the source driven IC 13, the first gate driven IC 14 is closer than the second gate driven IC 15. A third gate driven chip 16 and a forth gate driven chip 17 are symmetrically arranged in the lateral opposite to the first gate driven IC 14 and the second gate driven IC 15. Alternatively, the third gate driven chip 16 and the forth gate driven chip 17 may be arranged in the same lateral with the first gate driven IC 14 and the second gate driven IC 15.

The printed circuit board 12 provides gate driven signals ("VGH") to the first gate driven IC 14 and the second gate driven IC 15 via leading wires 1 and 2. It can be seen that the VGH to the second gate driven IC 15 is not only transmitted by the leading wires 1 but also by the leading wires 2. The leading wires 2 include additional resistors and parasitic capacitors so that the amplitude and the waveform of the second gate driven IC 15 and the first gate driven IC 14 are different. Accordingly, as shown in FIG. 3, the amplitude and the waveform of the VGH input to the first gate driven IC 14 (see curve 21) and the second gate driven IC 15 (see curve 22) are different. In addition, the amplitude and the waveform of the output signals of the first gate driven IC 14 (see curve 23) and the second gate driven IC 15 (see curve 24) are different as shown in FIG. 4.

The brightness of display areas controlled by the first gate driven IC 14 and the second gate driven IC 15 are different as the amplitude and the waveform of the input and output signal of the first gate driven IC 14 and the second gate driven IC 15 are different. It can be understood that the brightness of the display area controlled by the second gate driven IC 15 is smaller that of the display area controlled by the first gate driven IC 14. In addition, as the gate lines of the display panel 11 are horizontal, the brightness of the display panel 11 is vertically distributed so that the visual effect of the display panel 11 is not good enough.

SUMMARY

In one aspect, a display panel includes at least one data driven chip and at least a first and a second scanning driven chips is provided. The data driven chip and the at least first and second driven chips are arranged on a lateral area of the display panel. The at least one data driven chip includes a first scanning signal input, a data signal input terminal, a first scanning signal output terminal, and a data signal output terminal. Each of the at least first and second scanning driven chips includes a second scanning signal input terminal and a second scanning signal output terminal. The second scanning signal input terminals of the first and the second scanning driven chips connects to the first scanning signal output terminal of the data driven chip by a first and a second transmission circuit respectively. The first transmission circuit further includes a resistor serially connected between the data driven chip and the first scanning driven chip so that sum of impedance of the first transmission circuit is equal to sum of the impedance of the second transmission circuit, or the difference of the impedance of the first and the second transmission circuit is less than a predetermined value.

The first transmission circuit connecting includes leading wires, the resistor, and a capacitor. Two ends of the first transmission circuit axe the first scanning signal output terminal of the data driven chip and the second scanning signal input terminal of the scanning driven chip. The capacitor is connected in parallel with the resistor between the first scanning signal output terminal of the data driven chip and ground.

The sum of impedance of the first transmission circuit is obtained by summing the impedance of the resistor and the capacitor, and the values of the resistor and the capacitor are adjusted so that sum of impedance of the first transmission circuit is equal to sum of the impedance of the second transmission circuit or the difference of the impedance of the first and the second transmission circuit is less than a predetermined value.

The at least one scanning driven chip includes a third input terminal and a third output terminal, and the transmission signals are transmitted from the third input terminal to the third output terminal via at least one of the transmission circuits.

In another aspect, a flat-panel display device having a display panel is provided. The display panel includes at least one data driven chip and at least a first and a second scanning driven chips. The data driven chip and the at least first and second driven chips are arranged on a lateral area of the display panel. The at least one data driven chip includes a first scanning signal input, a data signal input terminal, a first scanning signal output terminal, and a data signal output terminal. Each of the at least first and second scanning driven chips includes a second scanning signal input terminal, and a second scanning signal output terminal. The second scanning signal input terminals of the first and the second scanning driven chips connects to the first scanning signal output terminal of the data driven chip by a first and a second transmission circuit respectively. The first transmission circuit further includes a resistor serially connected between the data driven chip and the first scanning driven chip so that sum of impedance of the first transmission circuit is equal to sum of the impedance of the second transmission circuit or the difference of the impedance of the first and the second transmission circuit is less than a predetermined value.

The sum of impedance of the first transmission circuit is equal to sum of impedance of the second transmission circuit, or a difference between the impedances of the first and the second transmission circuits is less than a predetermined value.

The first transmission circuit includes leading wires, the resistor, and a capacitor. Two ends of the first transmission circuit are the first scanning signal output terminal of the data driven chip and the second scanning signal input terminal of the scanning driven chip. The capacitor is connected in parallel with the resistor between the first scanning signal output terminal of the data driven chip and ground.

Sum of impedance of the first transmission circuit is obtained by summing the impedance of the resistor and the capacitor. The values of the resistor and the capacitor are adjusted so that sum of impedance of the first transmission circuit is equal to sum of the impedance of the second transmission circuit or the difference of the impedance of the first and the second transmission circuit is less than a predetermined value. At least one transmission circuit connects to the scanning driven chip.

The at least one scanning driven chip includes a third input terminal and a third output terminal, and the transmission signals are transmitted from the third input terminal to the third output terminal via at least one of the transmission circuits.

In another aspect, a driving method of a flat-panel display device is provided. The driving method includes: turning on a driven pixel switch to provide scanning driven signals to at least two scanning driven chips via a first and a second transmission circuits, wherein the first transmission circuit further includes a resistor serially connected between the data driven chip and the first scanning driven chip so that sum of impedance of the first transmission circuit is equal to sum of the impedance of the second transmission circuit or the difference of the impedance of the first and the second transmission circuit is less than a predetermined value; and providing data driven signals to data driven chips upon turning on the driven pixel switch so as to transmit the data driven signals to corresponding pixel operation units.

The turning on step further includes: providing scanning driven signals to at least two scanning driven chips by the data driven chip via the first and the second transmission circuits.

The transmission circuit further includes leading wires and a capacitor connected in parallel with the resistor between the data driven chip and ground.

The sum of impedance of the first transmission circuit is obtained by summing the impedance of the resistor and the capacitor. Values of the resistor and the capacitor is adjusted so that sum of impedance of the first transmission circuit is equal to sum of the impedance of the second transmission circuit, or the difference of the impedance of the first and the second transmission circuit is less than a predetermined value.

DETAILED DESCRIPTION OF THE EMBODIMENTS

The embodiments of the display panel of the invention reduce or even eliminate the vertical distribution of the brightness, so as to enhance the display effects of a display panel. The flat-panel display device may be liquid crystal displays, plasma displays, or organic light-emitting diode (OLED) displays. Embodiments of the invention will now be described more fully hereinafter with reference to the accompanying drawings, in which embodiments of the invention are shown.

Figure 1:
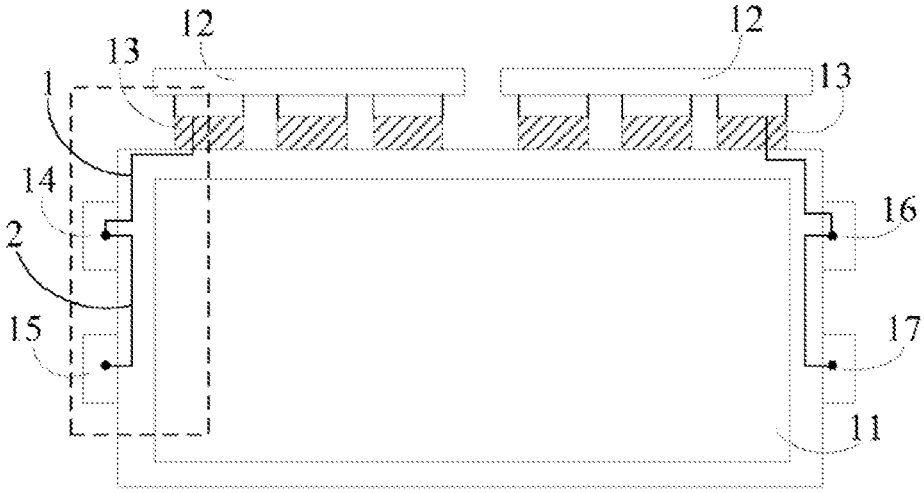
FIG. 1 (Prior Art)
FIG. 1 is an isometric view of layout of the driving chips of the display panel of prior art.
Figure 2:
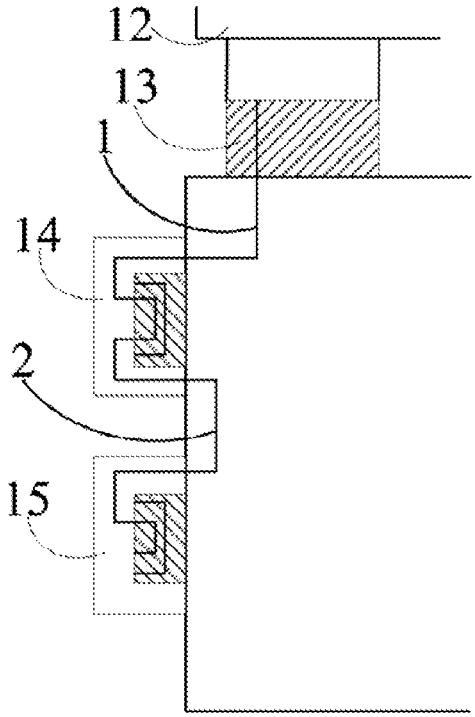
FIG. 2 (Prior Art)
FIG. 2 is an enlarged isometric view of the dashed section of FIG. 1.
Figure 3:
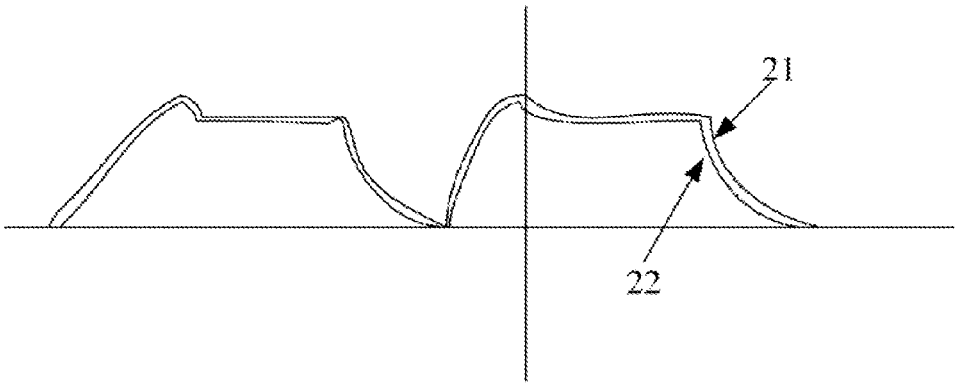
FIG. 3 (Prior Art)
FIG. 3 shows the amplitude and the waveform of the input signals of the first gate driven chip and the second gate driven chip as shown in FIG 2.
Figure 4:
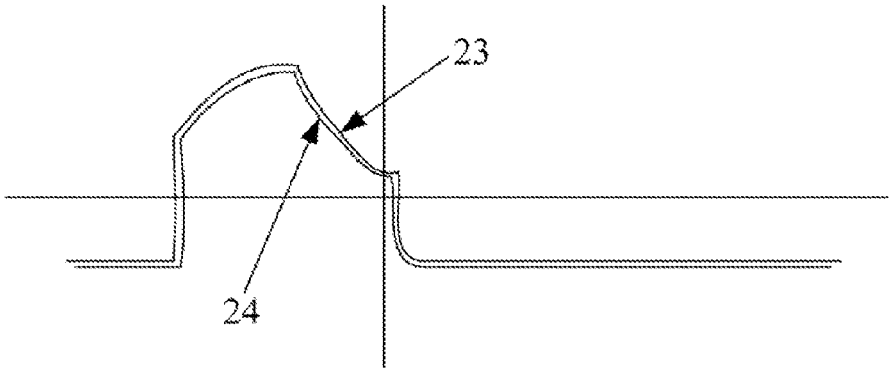
FIG. 4 (Prior Art)
FIG. 4 shows the amplitude and the waveform of the output signals of the first gate driven chip and the second gate driven chip as shown in FIG 2.
Figure 5:
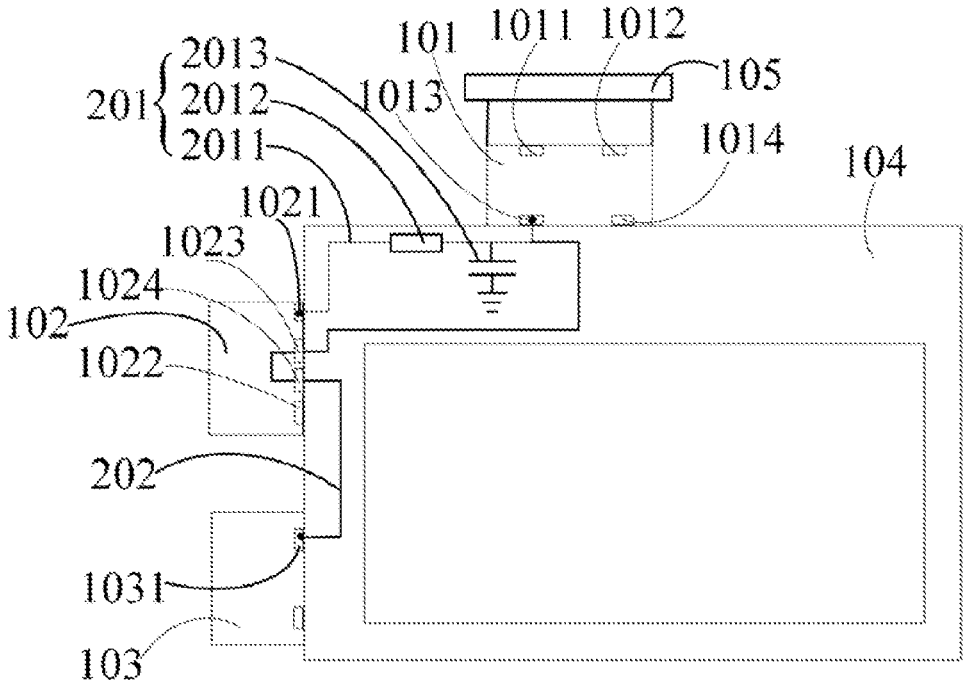
FIG. 5 is an isometric view of the circuit arrangement of the display panel of the first embodiment.

Referring now to the drawings in detail, FIG. 5 shows a first embodiment of the display panel according to the invention. The display panel includes a data driven chip 101, a first scanning driven chip 102, a second scanning driven chip 103, and a printed circuit board 105. The data driven chip 101, the first scanning driven chip 102, and the second scanning driven chip 103 are arranged on a lateral area 104 of the display panel. Data lines of the display panel (not shown) are arranged vertically and scanning lines of the display panel (not shown) are arranged horizontally. Thus, the data driven chip 101 is arranged vertically to the data lines, and the first scanning driven chip 102 and the second scanning driven chip 103 are arranged vertically to the scanning lines.

The data driven chip 101 includes a first scanning signal input terminal 1011, a data signal input terminal 1012, a first scanning signal output terminal 1013, and a data signal output terminal 1014. The first scanning driven chip 102 includes a second scanning signal input terminal 1021 and a second scanning signal output terminal 1022. The second scanning driven chip 103 includes a second scanning signal input terminal 1031 and a second scanning signal output terminal 1032. The printed circuit board 105 is connected to the data driven chip 101 so that data driven signals and scanning driven signals may be transmitted to the data driven chip 101, the first scanning driven chip 102, and the second scanning driven chip 103. The scanning driven signals are transmitted via the first scanning signal input terminal 1011 and the first scanning signal output terminal 1013 to the first scanning driven chip 102 and the second scanning driven chip 103.

Specifically, the second scanning signal input terminal 1021 of the first scanning driven chip 102 is connected to the first scanning signal output terminal 1013 of the data driven chip 101 by a first transmission circuit 201. The second scanning signal input terminal 1031 of the second scanning driven chip 103 is connected to the first scanning signal output terminal 1013 of the data driven chip 101 by a second transmission circuit 202. The scanning driven signals from the printed circuit board 105 to the first scanning driven chip 102 and second scanning driven chip 103 are first input to first scanning signal input terminal 1011 and then output from first scanning signal output terminal 1013 of the data driven chip 101. After outputting from the first scanning signal output terminal 1013, the scanning driven signals are transmitted to the first scanning driven chip 102 and second scanning driven chip 103 by the first transmission circuit 201 and the second transmission circuit 202, respectively. The data driven signals from the printed circuit board 105 to the data driven chip 101 are input to the data signal input terminal 1012 and then output from the data signal output terminal 1014.

In view of the above, the second scanning signal input terminal 1021 of the first scanning driven chip 102 and the second scanning signal input terminal 1031 of the second scanning driven chip 103 are connected to the first scanning signal output terminal 1013 of the data driven chip 101 via the first transmission circuit 201 and the second transmission circuit 202. The first transmission circuit 201 includes a first resistor 2012 serially connected so that sum of impedance of the first transmission circuit 201 is equal to the impedance of the second transmission circuit 202, or the difference of the impedance between the first transmission circuit 201 and the second transmission circuit 202 is less than a predetermined value. Specifically, the first transmission circuit 201 connected to the first scanning driven chip 102 includes first leading wires 2011, the first resistor 2012, and the first capacitor 2013. The first resistor 2012 is serially connected to the first leading wires 2011 between the first scanning signal output terminal 1013 of the data driven chip 101 and the second scanning signal input terminal 1021 of the first scanning driven chip 102. The first capacitor 2013 is connected in parallel with the first resistor 2012 between the first scanning signal output terminal 1013 of the data driven chip 101 and the ground.

The second transmission circuit 202 includes the leading wires connected to the first scanning signal output terminal 1013 of the data driven chip 101 and the second scanning signal input terminal 1031 of the second scanning driven chip 103. In the embodiments, the second transmission circuit 202 is connected to a third input terminal 1023 and a third output terminal 1024 of the first scanning driven chip 102 so as to transmit the signals from the third input terminal 1023 to the third output terminal 1024.

In the embodiments, the length of at least one of the leading wires or the resistivity of first transmission circuit 201 is different front that of the second transmission circuit 202. The first transmission circuit 201 includes the serially connected first resistor 2012 and the first capacitor 2013 connected in parallel so that the sum of impedance of the first transmission circuit 201 is obtained by summing the impedances of the resistor 2012 and the capacitor 2013. By adjusting values of the first resistor 2012 and the first capacitor 2013, the sum of impedance of the first transmission circuit 201 is equal to the impedance of the second transmission circuit 202.

However, it may be understood that the sum of impedance of the first transmission circuit 201 is not equal to the impedance of the second transmission circuit 202 due to real scenarios. Under the circumstances, the difference between the impedances of the first transmission circuit 201 and the second transmission circuit 202 may be controlled to be less than a predetermined value.

It is noted that the first transmission circuit 201 may include the first resistor 2012 and the first leading wires 2011, not including the first capacitor 2013. In addition, the first transmission circuit 201 may include more than one resistor. By adding more than one resistor in the first transmission circuit 201, the sum of impedance of the first transmission circuit 201 is equal to the impedance of the second transmission circuit 202, or the difference between the impedances of the first transmission circuit 201 and the second transmission circuit 202 is less than a predetermined value.

In the embodiments, the scanning driven signals are transmitted to the first scanning driven chip 102 and the second scanning driven chip 103 by the first transmission circuit 201 and the second transmission circuit 202, respectively. The first transmission circuit 201 includes the first resistor 2012 serially connected between the data driven chip 101 and the first scanning driven chip 102 and the first capacitor 2013 connected in parallel with the resistor 2012 and ground. The values of the resistor 2012 and the capacitor 2013 are adjusted so that sum of impedance of the first transmission circuit 201 is equal to the impedance of the second transmission circuit 202, or the difference between the impedances of the first transmission circuit 201 and the second transmission circuit 202 is less than a predetermined value. By adopting such a circuit arrangement, the amplitude and the waveform of the input signal of the first scanning driven chip 102 and the second scanning driven chip 103 are quite similar. The vertical distribution of the brightness of the display-panel is reduced or even eliminated so that the brightness of the display panel is uniform.

Figure 6:
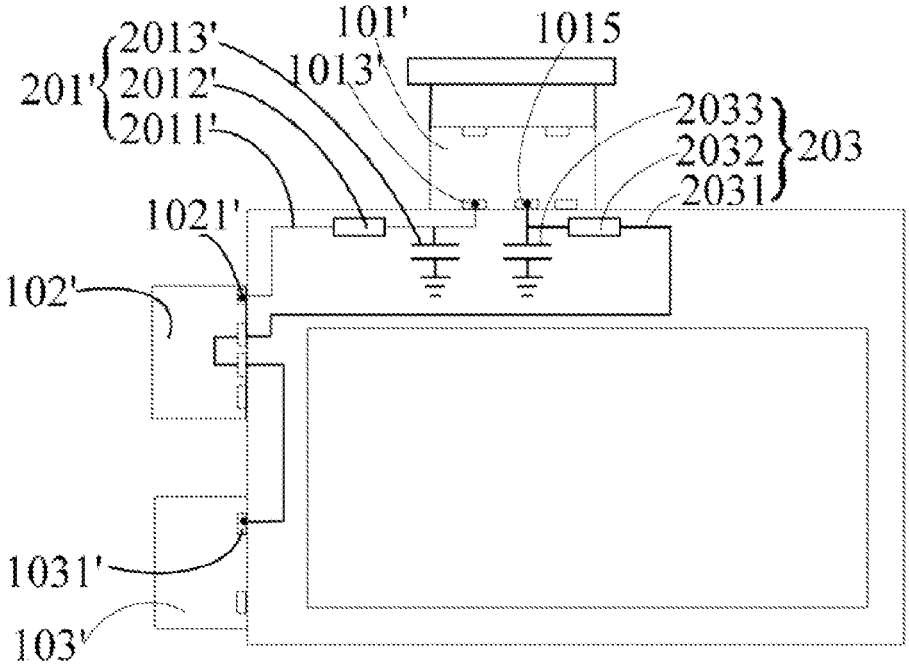
FIG 6 is an isometric view of the circuit arrangement of the display panel of the second embodiment.

As shown in FIG. 6, the second transmission circuit 203 connected to the second scanning driven chip 103" may have a circuit arrangement similar to the first transmission circuit 201 in FIG 5. In the embodiments, the second transmission circuit 203 includes second leading wires 2031, the second resistor 2032, and the second capacitor 2033. The first resistor 2012' is serially connected to the first leading wires 2011' between the first scanning signal output terminal 1013' of the data driven chip 101' and the second scanning signal input terminal 1021' of the first scanning driven chip 102'. The first capacitor 2013' is connected in parallel with the first resistor 2012' between the first scanning signal output terminal 1013' of the data driven chip 101' and the ground. The second capacitor 2033 is connected in parallel with the second resistor 2032. The data driven chip 101' includes a first scanning signal output terminal 1013' and a third scanning signal output terminal 1015. The first resistor 2012' is serially connected to the first scanning signal output terminal 1013' and the second resistor 2032 is serially connected to the third scanning signal output terminal 1015 so that the scanning driven signals are transmitted from the first scanning signal output terminal 1013' and the third scanning signal output terminal 1015 to the first scanning driven chip 102' and second scanning driven chip 103' via the first transmission circuit 201' and the second transmission circuit 203. By adjusting values of the first resistor 2012' and the second capacitor 2032, the sum of impedance of the first transmission circuit 201' is equal to sum of the impedance of the second transmission circuit 203, or the difference between the impedances of the first transmission circuit 201' and the second transmission circuit 203 is less than the predetermined value.

In addition, the second transmission circuit 203 may include the second leading wires 2031 and the second resistor 2032, but not including the second capacitor 2033. Alternatively, the second transmission circuit 203 may include the second leading wires 2031 and the second capacitor 2033, but not including the second resistor 2032. In some embodiments, the first transmission circuit 201 or 201' may adopt an arrangement similar to the second transmission circuit 203 described above. Furthermore, the first transmission circuit 201, 201' and the second transmission circuit 202, 203 may adopt other electronic components with similar attributes with the resistors and the capacitors. By adjusting the attributes of the electronic components, the sum of impedance of the first transmission circuit 201, 201' is equal to sum of the impedance of the second transmission circuit 202, 203, or the difference between the impedances of the first transmission circuit 201, 201' and the second transmission circuit 202, 203 is less than a predetermined value.

In some embodiments, there may be three scanning driven chips or more than three scanning driven chips. Under the circumstances, there are at least three transmission circuits arranged in the display panel, and at least one of the transmission circuits includes a serially connected resistor so that the sum of impedance of the transmission circuits is the same, or the difference of impedance between the transmission circuits is less than the predetermined value. For example, the display panel includes three scanning driven chips and three transmission circuits. One of the transmission circuits includes the serially connected resistor, and the other two transmission circuit may be two leading wires with the same length and resistance. By adjusting the resistance of the resistor, the sum of impedance of the transmission circuits is the same, or the difference of impedance between the transmission circuits is less than the predetermined value. In some embodiments, two or three of the transmission circuits may include the serially connected resistor. In other embodiments, when there are multiple data driven chips, the scanning driven signals are transmitted from the data driven chip that is closest to the scanning data chip. Further, the scanning driven signal may be transmitted from the printed circuit board to the scanning driven chips directly, without via the data driven chip.

Figure 7:
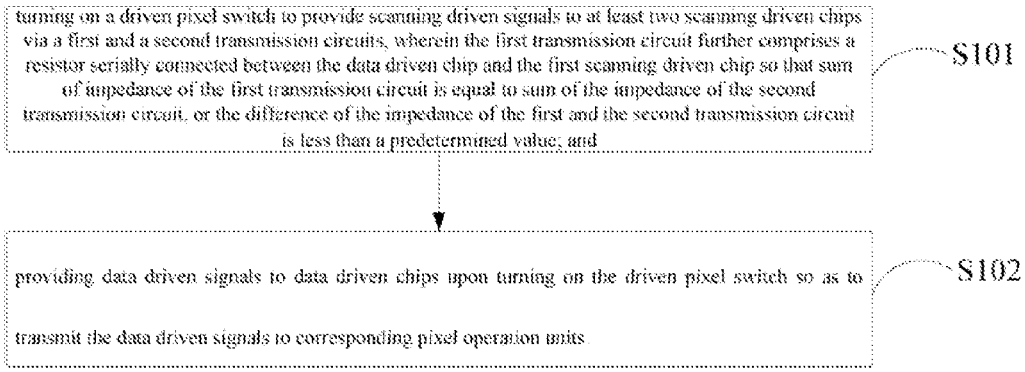
FIG 7 is a flowchart of the driving method of the flat-panel display device of one embodiment.

FIG 7 shows a driving method of the flat-panel display device according to an exemplary embodiment. In step S101, a driven pixel switch is turned on to provide scanning driven signals to at least two scanning driven chips 102, 103 via the first transmission circuit 201 and the second transmission circuits 202. The first transmission circuit 201 includes a resistor serially connected between the data driven chip 101 and the first scanning driven chip 102 so that sum of impedance of the first transmission circuit 201 is equal to sum of the impedance of the second transmission circuit 202, or the difference of impedance between the first transmission circuit 201 and the second transmission circuit 202 is less than the predetermined value.

Specifically, the printed circuit board 105 is connected to the display panel via the data driven chip 101 so that the data driven signals are transmitted to at least two scanning driven chips 102, 103 by the data driven chip 101 via the first transmission circuit 201 and the second transmission circuit 202 with the same impedance, or the difference of impedance between the first transmission circuit 201 and the second transmission circuit is less than the predetermined value.

In the embodiments, at least one transmission circuit connected to the scanning driven chip includes the leading wires, at least one serially connected resistor and the capacitor connected in parallel with the resistor. By adjusting values of the resistor and the capacitor, the sum of impedance of the first transmission circuit 201 is equal to sum of the impedance of the second transmission circuit 202, or the difference between the impedances of the first transmission circuit 201 and the second transmission circuit 202 is less than the predetermined value.

Specifically, there are at least two scanning driven chips with corresponding transmission circuits by which the scanning driven signals are transmitted to the at least two scanning driven chips. At least one of the transmission circuits includes the serially connected resistor. Embodiments of the display panel will be described with reference to FIG. 5, in which the display panel includes two scanning driven chips.

By turning on the driven pixels switch, the scanning driven signals are transmitted to the first scanning driven chip 102 and the second scanning driven chip 103 via the first transmission circuit 201 and the second transmission circuit 202, respectively. The first transmission circuit 201 includes the first leading wires 2011, the first resistor 2012, and the first capacitor 2013. The second transmission circuit 202 includes leading wires. The first leading wires 2011 and the first resistor 2012 of the first transmission circuit 201 are serially connected between the first scanning signal output terminal 1013 of the data driven chip 101 and the second scanning signal input terminal 1021 of the first scanning driven chip 102. The first capacitor 2013 is connected in parallel with the first resistor 2012 between the first scanning signal output terminal 1013 of the data driven chip 101 and the ground. The second transmission circuit 202 is connected to the first scanning signal output terminal 1013 of the data driven chip 101 and the second scanning signal input terminal 1031 of the second scanning driven chip 103. By adjusting values of the first resistor 2012 and the first capacitor 2013, the sum of impedance of the first transmission circuit 201 is equal to sum the impedance of the second transmission circuit 202.

In step S102, the data driven signals are provided to the data driven chips after the driven pixel switch is turned on. In this way, the data driven signals are input to corresponding pixel operation units, such as the pixel electrodes of the liquid crystal display, so as to drive the flat-panel display device.

The driving method of the flat-panel display device of the embodiment provides uniform brightness by making the signal input amplitude and waveform of the at least two scanning driven chips same. By adopting this driving method, the brightness of the flat-panel device is uniformly distributed so that the display performance is enhanced.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A display panel, comprising:

at least one data driven chip and at least a first and a second scanning driven chips;

the data driven chip and the at least first and second driven chips arranged on a lateral area of the display panel;

the at least one data driven chip comprising a first scanning signal input, a data signal input terminal, a first scanning signal output terminal, and a data signal output terminal;

each of the at least first and second scanning driven chips comprising a second scanning signal input terminal and a second scanning signal output terminal;

the second scanning signal input terminals of the first and the second scanning driven chips connected to the first scanning signal output terminal of the data driven chip by a first and a second transmission circuit respectively; and wherein the first transmission circuit further comprises a resistor serially connected between the data driven chip and the first scanning driven chip so that sum of impedance of the first transmission circuit is equal to sum of impedance of the second transmission circuit, or a difference of impedance between the first and the second transmission circuit is less than a predetermined value.

2. The display panel as claimed in claim 1, wherein the first transmission circuit comprises leading wires, the resistor, and a capacitor, two ends of the first transmission circuit being the first scanning signal output terminal of the data driven chip and the second scanning signal, input terminal of the scanning driven chip, the capacitor being connected in parallel with the resistor between the first scanning signal output terminal of the data driven chip and ground.

3. The display panel as claimed in claim 2, wherein the sum of impedance of the first transmission circuit is obtained by summing impedances of the resistor and the capacitor, values of the resistor and the capacitor being adjusted so that the sum of impedance of the first transmission circuit is equal to the sum of the impedance of the second transmission circuit, or the difference of impedance between the first and the second transmission circuit being less than a predetermined value.

4. The display panel as claimed in claim 1, wherein the at least one scanning driven chip comprises a third input terminal and a third output terminal and the transmission signals are transmitted from the third input terminal to the third output terminal via at least one of the transmission circuits.

5. A flat-panel display device having a display panel comprising:

the display panel comprising at least one data driven chip and at least a first and a second scanning driven chips;

the data driven chip and the at least first and second driven chips arranged on a lateral area of the display panel;

the at least one data driven chip comprising a first scanning signal input, a data signal input terminal, a first scanning signal output terminal, and a data signal output terminal;

each of the at least first and second scanning driven chips comprising a second scanning signal input terminal and a second scanning signal output terminal; and the second scanning signal input terminals of the first and the second scanning driven chips connected to the first scanning signal output terminal of the data driven chip by a first and a second transmission circuit respectively;

wherein the first transmission circuit further comprises a resistor serially connected between the data driven chip and the first scanning driven chip so that sum of impedance of the first transmission circuit is equal to sum of impedance of the second transmission circuit, or a difference between the impedances of the first and the second transmission circuits is less than a predetermined value.

6. The flat-panel display device as claimed in claim 5, wherein sum of impedance of the first transmission circuit is equal to sum of impedance of the second transmission circuit, or a difference between the impedances of the first and the second transmission circuits is less than a predetermined value.

7. The flat-panel display device as claimed in claim 6, wherein the first transmission circuit comprises leading wires, the resistor, and a capacitor, two ends of the first transmission circuit being the first scanning signal output terminal of the data driven chip and the second scanning signal input terminal of the scanning driven chip, the capacitor being connected in parallel with the resistor between the first scanning signal output terminal of the data driven chip and ground.

8. The flat-panel display device as claimed in claim 7, wherein the sum of impedance of the first transmission circuit is obtained by summing impedances of the resistor and the capacitor, values of the resistor and the capacitor being adjusted so that the sum of impedance of the first transmission circuit is equal to the sum of the impedance of the second transmission circuit, or the difference of impedance between the first and the second transmission circuit is less than a predetermined value.

9. The flat-panel display device as claimed in claim 5, wherein at least one transmission circuit is connected to the scanning driven chip.

10. The flat-panel display device as claimed in claim 5, wherein the at least one scanning driven chip comprises a third input terminal and a third output terminal and the transmission signals are transmitted from the third input terminal to the third output terminal via at least one of the transmission circuits.

11. A driving method of a flat-panel display device, comprising:

turning on a driven pixel switch to provide scanning driven signals to at least two scanning driven chips via a first and a second transmission circuits, wherein the first transmission circuit further comprises a resistor serially connected between the data driven chip and the first scanning driven chip so that sum of impedance of the first transmission circuit is equal to sum of the impedance of the second transmission circuit, or the difference of the impedance of the first and the second transmission circuit is less than a predetermined value; and providing data driven signals to data driven chips upon turning on the driven pixel switch so as to transmit the data driven signals to corresponding pixel operation units.

12. The method as claimed in claim 11, wherein the turning on step further comprises: providing scanning driven signals to at least two scanning driven chips by the data driven chip via the first and the second transmission circuits.

13. The method as claimed in claim 11, wherein the transmission circuit further comprises leading wires and a capacitor connected in parallel with the resistor between the data driven chip and ground.

14. The method as claimed in claim 13, wherein the sum of impedance of the first transmission circuit is obtained by summing impedances of the resistor and the capacitor, the values of the resistor and the capacitor being adjusted so that sum of impedance of the first transmission circuit is equal to sum of the impedance of the second transmission circuit, or the difference of the impedance of the first and the second transmission circuit is less than a predetermined value.

* * * * *